US008945349B2

(12) United States Patent
Zhu et al.

(10) Patent No.: US 8,945,349 B2
(45) Date of Patent: Feb. 3, 2015

(54) ELECTRICAL HEATING COAL MATERIAL DECOMPOSITION APPARATUS

(75) Inventors: Shucheng Zhu, Nanyang (CN); Xibin Wang, Nanyang (CN); Xiangyun Huang, Nanyang (CN); Guochao Cao, Nanyang (CN); Wei Liu, Nanyang (CN)

(73) Assignee: Xixia Dragon Into Special Material Co., Ltd. (CN)

( * ) Notice: Subject to any disclaimer, the term of this patent is extended or adjusted under 35 U.S.C. 154(b) by 103 days.

(21) Appl. No.: 13/814,290

(22) PCT Filed: Sep. 15, 2010

(86) PCT No.: PCT/CN2010/076973

§ 371 (c)(1),
(2), (4) Date: Feb. 5, 2013

(87) PCT Pub. No.: WO2012/022057

PCT Pub. Date: Feb. 23, 2012

(65) Prior Publication Data

US 2013/0134031 A1 May 30, 2013

(30) Foreign Application Priority Data

Aug. 19, 2010 (CN) ..... 2010 1 0262809

(51) Int. Cl.
*C10B 21/20* (2006.01)
*C10B 53/04* (2006.01)
(Continued)

(52) U.S. Cl.
CPC ..... *C10B 53/04* (2013.01); *C10B 19/00* (2013.01); *C10B 47/30* (2013.01); *C10B 47/32* (2013.01); *C10K 1/02* (2013.01); *C10K 1/04* (2013.01)
USPC ..... 202/99; 202/117; 202/131; 202/133; 202/145; 202/216; 202/217; 202/226; 202/261; 432/112; 432/114; 432/154

(58) Field of Classification Search
USPC ..... 202/99, 117, 131, 133, 145, 216, 217, 202/226, 261; 432/114, 112, 154; 219/200
See application file for complete search history.

(56) References Cited

U.S. PATENT DOCUMENTS 1,675,315 A 6/1928 Trent
4,352,969 A * 10/1982 Wulf ..... 219/652
(Continued)

FOREIGN PATENT DOCUMENTS

CN 2498158 Y 7/2002
CN 2627438 Y 7/2004
(Continued)

OTHER PUBLICATIONS

International Search Report for PCT/CN2010/076973, mail date May 26, 2011.

*Primary Examiner* — Nina Bhat
(74) *Attorney, Agent, or Firm* — Rossi, Kimms & McDowell LLP

(57) ABSTRACT

An electrical heating coal material decomposition apparatus includes a closed kiln body with a feed inlet, a discharge outlet, and an electrical heating device arranged in the kiln body. A propulsion and decomposition path of coal material is formed between the electrical heating device and the inner wall of the kiln body. A coal decomposition gas collecting pipe communicates with the propulsion and decomposition path of coal material, and is connected with a gas dust-trapping and liquefying device arranged outside the kiln. The electrical heating device transfers heat to the pulverized coal inside the propulsion and decomposition path of coal material by conduction and irradiation. The pulverized coal absorbs sufficient heat and decomposes into fuel gas, tar gas and coal. The fuel gas and tar gas enters the gas dust-trapping and liquefying mechanism through the decomposed gas collecting tube, where they are collected, dust-trapped, separated and liquefied under pressure.

15 Claims, 1 Drawing Sheet

(51) Int. Cl.

| | |
|---|---|
| ***C10B 19/00*** | (2006.01) |
| ***C10B 47/30*** | (2006.01) |
| ***C10B 47/32*** | (2006.01) |
| ***C10K 1/02*** | (2006.01) |
| ***C10K 1/04*** | (2006.01) |

(56) References Cited

U.S. PATENT DOCUMENTS

| | | | | |
|---|---|---|---|---|
| 4,931,610 | A * | 6/1990 | Hughes et al. | 219/618 |
| 5,151,159 | A * | 9/1992 | Wolfe et al. | 202/118 |
| 5,869,810 | A * | 2/1999 | Reynolds et al. | 219/388 |
| 5,997,289 | A * | 12/1999 | Dover | 432/118 |
| 8,470,134 | B2 * | 6/2013 | Rinker | 201/29 |
| 2009/0217574 | A1 * | 9/2009 | Coleman et al. | 44/501 |

FOREIGN PATENT DOCUMENTS

| | | | |
|---|---|---|---|
| CN | 2867240 | Y | 2/2007 |
| CN | 201034412 | Y | 3/2008 |

* cited by examiner

ELECTRICAL HEATING COAL MATERIAL DECOMPOSITION APPARATUS

This application is a U.S. National Phase application of PCT International Application PCT/CN2010/076973 filed on Sep. 15, 2010, which is based on and claims priority from CN 201010262809.3 filed on Aug. 19, 2010 the contents of which is incorporated in its entirety by reference.

FIELD OF THE INVENTION

The invention relates to a comprehensive utilization of coal material for energy saving and emission reduction, particularly relates to an electrical heating coal material decomposition apparatus.

BACKGROUND OF THE INVENTION

In conventional technology, coal is used to produce coal gas, natural gas, or used to produce gas by coking at high temperature, medium temperature or low temperature. However, the above-mentioned technology is required to form pulverized coal into lumps or sift lump coal, which increases the cost of raw material, or result in the produced gas without a high heat value, a big additional value, and a significant economic and social benefits.

The heating mode of furnace can be classified as external-heating mode, internal-heating mode and hybrid-heating mode. The heating medium in external-heating furnace is not contact directly with raw materials and heat is transferred from furnace wall. The heating medium in the internal-heating furnace contacts with the raw materials directly, and the heating methods are classified as solid heat carrier mode and gas heat carrier mode according to different heat mediums.

The method in internal-heating mode and gas heat carrier mode is a typical method used in the industry. This method uses a vertical continuous furnace in internal heating mode and gas heat carrier mode, which includes three parts from top to bottom: a drying section, a decomposition section and a cooling section. Lignite coals or their compressed blocks (about 25~60 mm) move from top to bottom to countercurrent contact with the combustion gas directly so as to be heated for decomposition at low temperature. When a moisture content of raw material in furnace roof is about 15%, the raw material should be dried in the drying section to attain a moisture content below 1.0%, and the upstream hot combustion gas at about 250 degrees centigrade is cooled to a temperature at 80~100 degrees centigrade. Then, the dried raw material is heated to about 500 degrees centigrade by the oxygen-free combustion gas at 600~700 degrees centigrade in the decomposition section to be decomposed; The hot gas is cooled to about 250 degrees centigrade, and the produced semi-coke is transferred to the cooling section and cooled by cool gas. Thereafter, the semi-coke is discharged and further cooled by water and air. The volatiles escaped from the decomposition section are subjected to condensation and cooling steps, etc to attain tar and pyrolysis water. This kind of furnace has ever been built in Germany, United States, Soviet Union, Czechoslovakia, New Zealand and Japan.

The method in internal-heating mode and solid heat carrier mode is a typical method of internal heating style. The raw materials are lignite coal, non-caking coal, weakly-caking coal and oil shale. In the 1950s, there is an intermediate testing apparatus built with a processing capacity of 10t/h coal in Dorsten of Federal Republic of Germany, and the used heat carrier are solid particles (small ceramic balls, sands or semi-cokes). Since the process product gas does not include exhaust gas, the equipment for later processing system has a smaller size and the gas has a higher heat value up to 20.5~40.6 MJ/m3. The method has a large processing capacity because of its large temperature difference, small particles and fast heat transfer. The resulting liquid products constitute a majority and the yield can be up to 30% when processing high-volatile coal. The technical process of L-R method for low-temperature coal decomposition is firstly mixing the preheated small blocks of raw coals with the hot semi-coke from separator in the mixer so as to initiate a thermal decomposition. Then, they are falling into the buffer, and staying a certain time to complete the thermal decomposition. The semi-cokes from buffer come into the bottom of a riser, and are transmitted by hot air and burned off the residual carbon therein in riser at the same time so as to raise the temperature, and then the semi-coke is introduced into the separator for gas-solid separation. After that, the semi-cokes are returned to the mixer, and so circulated. A high heat value gas can be attained from the escaped volatiles from the mixer after dedusting, condensation, cooling and recycling oils.

At present, there are two kinds of conventional coal decomposition apparatus, one of which has an up-draft kiln structure. The up-draft kiln structure is used for combusting flue gas and combustible gases produced by coal, which has low gas purity and a low additional value, as well as partially discharge of gas. This results in a significant resources wasting and environmental pollution. Another kind of coal decomposition equipment has a shaft kiln structure. In the structure, coal lumps are placed on clapboard with holes, and a heater is provided above the coal lumps. Because the coal lumps on the clapboard are accumulated to a certain thickness, so they cannot be uniformly heated and decomposed, and are required to be cyclically heated and decomposed by the decomposed gas, wherein coal lumps are decomposed with a lower rate than that of pulverized coal . More importantly, since the presence of large amount of holes for ventilation and circulatory function provided on the clapboard, pulverized coal can leak through the holes. To avoid this, it is necessary to process the pulverized coal into coal briquette when introducing it into the shaft kiln. Thus, it will increase the cost of pulverized coal decomposition, and reduce the economic benefits because the pulverized coal cannot be directly used for coal decomposition in up-draft kiln.

SUMMARY OF THE INVENTION

To solve the above problems present in prior arts, an object of the present invention is to provide an electrical heating coal material decomposition apparatus, by which the pulverized coal can be separated directly and thus improving their overall utilization value and saving energy, and so as to enhance its economic and social benefits.

An electrical heating coal material decomposition apparatus includes a closed kiln body with a feed inlet and a discharge outlet. An electrical heating device is arranged in the kiln body. A propulsion and decomposition path of coal material is formed between the electrical heating device and the inner wall of the kiln. A coal decomposition gas collecting pipe which is communicated with the propulsion and decomposition path of coal material is arranged on the kiln body. The electrical heating device is rotatably arranged relative to the kiln body. A rotary propulsion device is arranged in the inner wall of the kiln body.

According to an embodiment of the invention, the rotary propulsion device arranged in the inner wall of the kiln body is a rising plate.

According to an embodiment of the invention, the electrical heating device comprises power supplies connected with each other, a temperature controller arranged in the kiln body, and a heating and radiating pipe.

According to an embodiment of the invention, the heating and radiating pipe is provided with one or more heating plates thereon.

According to an embodiment of the invention, there is a support plate arranged between the heating and radiating pipe and the inner wall of the kiln body.

According to an embodiment of the invention, the heating and radiating pipe is a single pipe, in which is equipped with a resistance wire.

According to an embodiment of the invention, the heating and radiating pipe is a plurality of U-shaped pipes in parallel.

According to the present invention, a reliable heating method which can be operated conveniently with technology maturity is introduced into pulverized coal decomposition field, such that a large amount of heat produced by the electrical heating apparatus are conducted and radiated to the pulverized coal in the channel. Thus, the pulverized coal can fully absorb the heat so as to be heated for being decomposed into the gas, coal tar gas and coal with high heat-value in the channel. The gas and coal tar gas communicate with a gas dedusting and liquefaction facility external to the kiln body through the coal decomposition gas collecting pipe, and the decomposed gas and coal tar gas are collected, dedusted, separated, and liquefied under pressure by the gas dedusting and liquefaction facility. The rotary propulsion device arranged in the inner wall of the kiln body results in the pivoting advance of coal material and its sufficient contact with the heating and radiating pipe, so as to improve the performance of coal decomposition. The support plate is arranged between the heating and radiating pipe and the inner wall of the kiln body, which assure safety and reliability of the whole system. The electrical heating coal apparatus is provided with one or more heating plates thereon, which increases the contact area between the heater and coal material, accelerates the transfer of heat, and increases the decomposition rate of coal. The heating and radiating pipe is a plurality of U-shaped pipes in parallel, which can transfer heat produced to pulverized coal more significantly. The decomposition apparatus for coal disclosed by the present invention makes the decomposition and separation of the pulverized coal more fast and efficient so as to save and fully utilize energy and greatly increase the utilization rate and level of coal resources, thus it will produce a significant economic and social benefits for the entire society.

BRIEF DESCRIPTION OF THE DRAWINGS

The accompanying drawings facilitate an understanding of the various embodiments of this invention, in which.

DETAILED DESCRIPTION OF THE INVENTION

Embodiment 1

Figure 1:
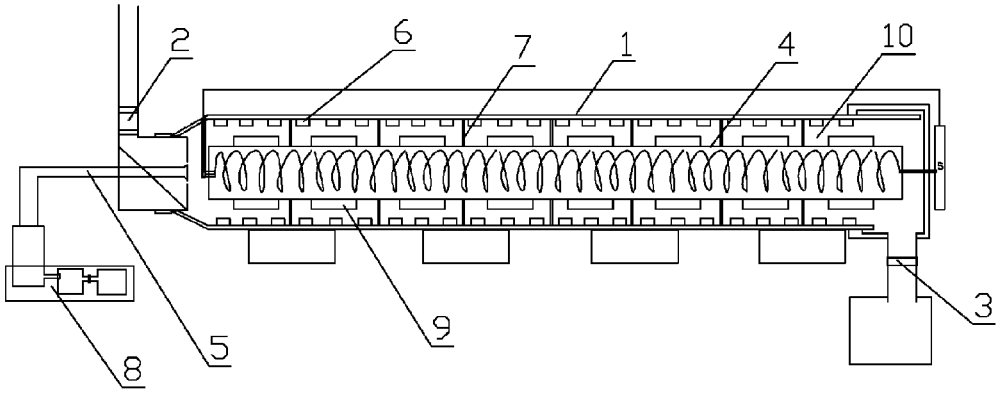
FIG. 1 is a schematic diagram according to a first embodiment of the present invention.

As shown in FIG. 1, an electrical heating coal material decomposition apparatus includes a closed kiln body 1 with a feed inlet 2 and a discharge outlet 3. An electrical heating device is arranged in the kiln body 1. A propulsion and decomposition path of coal material 10 is formed between the electrical heating device and the inner wall of the kiln 1. A tube 5 for collecting decomposed gas from coal which is communicated with the propulsion and decomposition path of coal material 10 is arranged on the kiln body 1. The tube 5 for collecting decomposed gas from coal is connected with a gas dust-trapping and liquefying device 8 which is arranged outside the kiln 1. The electrical heating device is rotatably arranged relative to the kiln body 1. A rotary propulsion device 6 is arranged in the inner wall of the kiln body 1. Such heating device which can be operated conveniently with technology maturity produces a large amount of heat, which is conducted and radiated to the pulverized coal in the channel 10. Thus, the pulverized coal can fully absorb the heat so as to be heated for being decomposed into the gas, coal tar gas and coal with high heat-value in the channel 10. The gas and coal tar gas communicate with a gas dedusting and liquefaction facility 8 external to the kiln body 1 through the coal decomposition gas collecting pipe 5, and the decomposed gas and coal tar gas are collected, dedusted, separated, and liquefied under pressure by the gas dedusting and liquefaction facility. The rotary propulsion device 6 arranged in the inner wall of the kiln body 1 is a rising plate, which results in the pivoting advance of coal material and its sufficient contact with the heating and radiating pipe 4, so as to improve the performance of coal decomposition. The electrical heating device comprises power supplies connected with each other, a temperature controller arranged in the kiln body, and a heating and radiating pipe 4. The heating and radiating pipe 4 is provided with one or more heating plates 9 thereon, which increases the contact area between the heater and coal material, accelerates the transfer of heat, and increases the decomposition rate of coal. There is a support plate 7 arranged between the heating and radiating pipe 4 and the inner wall of the kiln body 1, which assure safety and reliability of the whole system. The heating and radiating pipe 4 is a single pipe, in which is equipped with a resistance wire.

Embodiment 2

Figure 2:
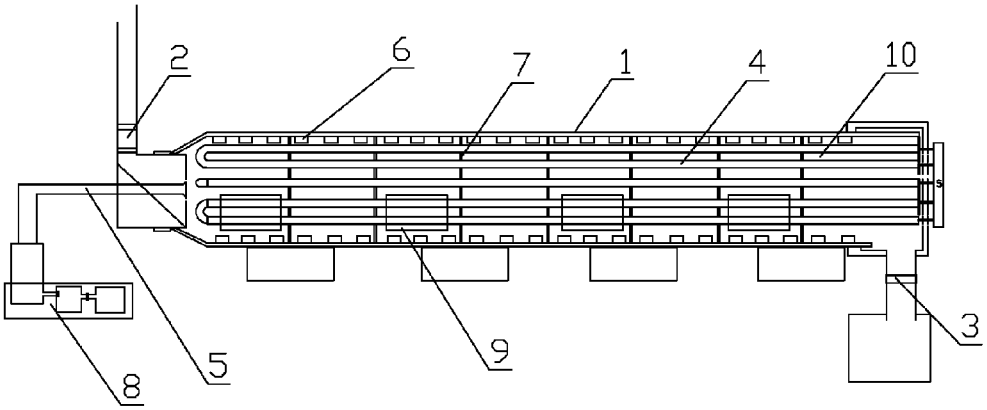
FIG. 2 is a schematic diagram according to a second embodiment of the present invention.

As shown in FIG. 2, an electrical heating coal material decomposition apparatus includes a closed kiln body 1 with a feed inlet 2 and a discharge outlet 3. An electrical heating device is arranged in the kiln body 1. A propulsion and decomposition path of coal material 10 is formed between the electrical heating device and the inner wall of the kiln 1. A tube 5 for collecting decomposed gas from coal which is communicated with the propulsion and decomposition path of coal material 10 is arranged on the kiln body 1. The tube 5 for collecting decomposed gas from coal is connected with a gas dust-trapping and liquefying device 8 which is arranged outside the kiln 1. The electrical heating device is rotatably arranged relative to the kiln body 1. A rotary propulsion device 6 is arranged in the inner wall of the kiln body 1. Such heating device which can be operated conveniently with technology maturity produces a large amount of heat, which is conducted and radiated to the pulverized coal in the channel 10. Thus, the pulverized coal can fully absorb the heat so as to be heated for being decomposed into the gas, coal tar and coal with high heat-value in the channel 10. The gas and coal tar gas communicate with a gas dedusting and liquefaction facility 8 external to the kiln body 1 through the coal decomposition gas collecting pipe 5, and the decomposed gas and coal tar gas are collected, dedusted, separated, and liquefied under pressure by the gas dedusting and liquefaction facility. The rotary propulsion device 6 arranged in the inner wall of the kiln body 1 is a rising plate, which results in the pivoting advance of coal material and its sufficient contact with the heating and radiating pipe 4, so as to improve the performance of coal decomposition. The electrical heating device comprises power supplies connected with each other, a temperature controller arranged in the kiln body, and a heating and radiating pipe 4. The heating and radiating pipe 4 is provided with one or more heating plates 9 thereon, which increases the contact area between the heater and coal material, accelerates the transfer of heat, and increases the decomposition rate of coal. There is a support plate 7 arranged between the heating and radiating pipe 4 and the inner wall of the kiln body 1, which assure safety and reliability of the whole system. The heating and radiating pipe 4 is a plurality of U-shaped pipes in parallel, which can transfer heat produced to pulverized coal more significantly.

What is claimed is:

1. An electrical heating coal material decomposition apparatus comprising:

a closed kiln body with a feed inlet and a discharge outlet, wherein an electrical heating device is arranged in the kiln body, a propulsion and decomposition path of coal material is formed between the electrical heating device and the inner wall of the kiln body, a coal decomposition gas collecting pipe which is communicated with the propulsion and decomposition path of coal material is arranged on the kiln body, and the coal decomposition gas collecting pipe is connected with a gas dust-trapping and liquefying device which is arranged outside the kiln body; and wherein the electrical heating device is rotatably arranged relative to the kiln body and a rotary propulsion device is arranged in the inner wall of the kiln body.

2. The electrical heating coal material decomposition apparatus according to claim 1, wherein the rotary propulsion device arranged in the inner wall of the kiln body is a rising plate.

3. The electrical heating coal material decomposition apparatus according to claim 1, wherein the electrical heating device comprises power supplies connected with each other, a temperature controller arranged in the kiln body, and a heating and radiating pipe.

4. The electrical heating coal material decomposition apparatus according to claim 3, wherein the heating and radiating pipe is provided with one or more heating plates thereon.

5. The electrical heating coal material decomposition apparatus according to claim 3, wherein there is a support plate arranged between the heating and radiating pipe and the inner wall of the kiln body.

6. The electrical heating coal material decomposition apparatus according to claim 5, wherein the heating and radiating pipe is a single pipe, in which is equipped with a resistance wire.

7. The electrical heating coal material decomposition apparatus according to claim 5, wherein the heating and radiating pipe is a plurality of U-shaped pipes in parallel.

8. The electrical heating coal material decomposition apparatus according to claim 2, wherein the electrical heating device comprises power supplies connected with each other, a temperature controller arranged in the kiln body, and a heating and radiating pipe.

9. The electrical heating coal material decomposition apparatus according to claim 8, wherein the heating and radiating pipe is provided with one or more heating plates thereon.

10. The electrical heating coal material decomposition apparatus according to claim 8, wherein there is a support plate arranged between the heating and radiating pipe and the inner wall of the kiln body.

11. The electrical heating coal material decomposition apparatus according to claim 9, wherein there is a support plate arranged between the heating and radiating pipe and the inner wall of the kiln body.

12. The electrical heating coal material decomposition apparatus according to claim 10, wherein the heating and radiating pipe is a single pipe, in which is equipped with a resistance wire.

13. The electrical heating coal material decomposition apparatus according to claim 11, wherein the heating and radiating pipe is a single pipe, in which is equipped with a resistance wire.

14. The electrical heating coal material decomposition apparatus according to claim 10, wherein the heating and radiating pipe is a plurality of U-shaped pipes in parallel.

15. The electrical heating coal material decomposition apparatus according to claim 11, wherein the heating and radiating pipe is a plurality of U-shaped pipes in parallel.

* * * * *